US009303824B2

(12) United States Patent
Sun

(10) Patent No.: US 9,303,824 B2
(45) Date of Patent: Apr. 5, 2016

(54) LED LIGHTING DEVICE

(71) Applicant: Tai-Yin Huang, Macungie, PA (US)

(72) Inventor: Tseng-Bao Sun, Taichung (TW)

(73) Assignee: Tai-Yin Huang, Macungie, PA (US)

( * ) Notice: Subject to any disclaimer, the term of this patent is extended or adjusted under 35 U.S.C. 154(b) by 21 days.

(21) Appl. No.: 14/485,695

(22) Filed: Sep. 13, 2014

(65) Prior Publication Data

US 2015/0077997 A1 Mar. 19, 2015

(30) Foreign Application Priority Data

Sep. 18, 2013 (TW) ..... 102217595

(51) Int. Cl.

| | |
|---|---|
| ***F21K 99/00*** | (2010.01) |
| ***F21V 29/83*** | (2015.01) |
| *F21V 23/00* | (2015.01) |
| *F21Y 101/02* | (2006.01) |
| *F21V 3/02* | (2006.01) |
| *F21Y 111/00* | (2006.01) |
| *F21V 29/506* | (2015.01) |
| *F21V 29/74* | (2015.01) |

(52) U.S. Cl.

CPC ..... *F21K 9/1355* (2013.01); *F21V 29/83* (2015.01); *F21V 3/02* (2013.01); *F21V 23/003* (2013.01); *F21V 29/506* (2015.01); *F21V 29/74* (2015.01); *F21Y 2101/02* (2013.01); *F21Y 2111/005* (2013.01)

(58) Field of Classification Search

CPC ..... F21K 9/1355; F21V 29/83; F21V 23/003; F21V 3/02; F21V 29/506; F21V 29/74; F21Y 2101/02; F21Y 2111/005

USPC ..... 362/249.02, 311.02, 373, 294

See application file for complete search history.

(56) References Cited

U.S. PATENT DOCUMENTS

| | | | | |
|---|---|---|---|---|
| 8,414,160 | B2 * | 4/2013 | Sun | F21V 29/2206 313/46 |
| 8,596,821 | B2 * | 12/2013 | Brandes | F21K 19/135 362/249.01 |
| 2008/0316755 | A1 * | 12/2008 | Zheng | F21V 29/004 362/373 |
| 2009/0116233 | A1 * | 5/2009 | Zheng | F21K 9/135 362/234 |
| 2009/0296402 | A1 * | 12/2009 | Chang | F21V 29/004 362/294 |
| 2010/0265710 | A1 * | 10/2010 | Xiao | F21V 19/0055 362/249.02 |
| 2010/0284188 | A1 * | 11/2010 | Chen | F21K 9/135 362/249.02 |
| 2012/0268936 | A1 * | 10/2012 | Pickard | F21K 9/135 362/249.02 |
| 2013/0016508 | A1 * | 1/2013 | Progl | F21V 3/02 362/235 |
| 2013/0051003 | A1 * | 2/2013 | Fan | F21K 9/13 362/231 |
| 2014/0340870 | A1 * | 11/2014 | Premysler | F21K 9/56 362/84 |

* cited by examiner

*Primary Examiner* — Laura Tso

(74) *Attorney, Agent, or Firm* — Li & Cai Intellectual Property (USA) Office

(57) ABSTRACT

The present disclosure provides an LED lighting device comprising a heat dissipation body, a driver module and a lighting module. The heat dissipation body includes a base, a heat dissipation wall, heat dissipation fins and a top face. The heat dissipation wall defines a heat dissipation channel therein and is formed with first through holes. The heat dissipation fins are formed on and encircle the heat dissipation wall. The top face is formed with a first opening The driver module is disposed inside the heat dissipation body. The lighting module includes a tube body and LED light sources. The tube body has two end openings in fluid communication with each other and one of the end openings is connected to the first opening The LED light sources are arranged on the tube body and are electrically connected to the driver module.

9 Claims, 6 Drawing Sheets

LED LIGHTING DEVICE

BACKGROUND OF THE INVENTION

1. Field of the Invention

The present disclosure relates to an LED light bulb; in particular, to an LED light bulb having good heat dissipating effect.

2. Description of Related Art

With increasing awareness to environmentalism, light-emitting diode (LED) lamps having high energy efficiency and long life span have become more popular and have replaced traditional incandescent light bulbs as the mainstream product on the market.

Referring to FIG. 1, an LED light bulb la includes a cap 10*a* and at least three light-emitting modules 20*a*. Each of the light-emitting modules 20*a* includes a substrate 21*a*. A plurality of LED chips 22*a* are disposed on the two sides of each of the substrates 21*a*. The LED chips 22*a* are electrically connected to the cap 10*a* through the substrates 21*a*.

However, even though a conventional LED light bulb has the abovementioned advantages, heat dissipation is problematic when high wattage is required for high illumination, leading to serious degradation of light output.

In practice, typical LED light bulbs on the market are 7 to 8 watts. When higher wattages are to be used (e.g. for street lights), the light bulbs have serious problems of heat dissipation. The excessively high temperature inside the lamps leads to serious degradation of light output, such that the light bulbs cannot meet the demands for high luminance.

Hence, the present inventor believes the above mentioned disadvantages can be overcome, and through devoted research combined with application of theory, finally proposes the present disclosure which has a reasonable design and effectively improves upon the above mentioned disadvantages.

SUMMARY OF THE INVENTION

The objective of the present disclosure is to provide an LED light bulb having a specific structure for heat dissipation, thereby satisfying the requirement for high luminance using high wattages, without creating problems of lighting degradation due to poor heat dissipation.

In order to achieve the aforementioned objective, the present disclosure provides an LED light bulb, connected to a cap. The LED light bulb includes a heat dissipation body, a driver module and a lighting module. The heat dissipation body includes a base, a heat dissipation wall, a plurality of heat dissipation fins and a top face. The base is connected to the cap. The heat dissipation wall defines a heat dissipation channel. One end of the heat dissipation wall is connected to the base. A plurality of first through holes are formed on the heat dissipation wall and are in fluid communication with the heat dissipation channel. The heat dissipation fins are formed on and encircle the heat dissipation wall. The top face is formed at the other end of the heat dissipation wall and is formed with a first opening The driver module is disposed inside the heat dissipation body and is electrically connected to the cap. The lighting module includes a tube body and a plurality of LED light sources. The tube body has a hollow portion and two end openings in fluid communication with the hollow portion. The tube body is connected to the top face and one of the end openings is connected to the first opening The LED light sources are arranged on the tube body and are electrically connected to the driver module.

In a preferred embodiment, the heat dissipation body includes a partition board which is connected to the heat dissipation wall and partitions the heat dissipation wall into a first section and a second section. The top face, the first section and the partition board defines a first space in the heat dissipation channel. The partition board, the second section and base define a second space in the heat dissipation channel. The first space is in fluid communication with the tube body. The first through holes are arranged at the first section and in fluid communication with the first space. The driver module is disposed in the second space. A plurality of second through holes are formed on the second section of the heat dissipation wall and is in fluid communication with the second space.

In another preferred embodiment, a ventilation cover is arranged at the other end opening of the tube body.

The present disclosure has the following advantages. The heat dissipation body is in fluid communication with the ambient through the tube body of the lighting module, and the first through holes formed on the heat dissipation wall allow convective flow in the heat dissipation wall, such that the heat produced by the LED light sources can be quickly dissipated. Therefore, the present disclosure can use high wattage lighting modules without sacrificing the life span or creating serious degradation of light output. The heat dissipation body of the present disclosure includes a partition board to prevent humidity in the ambient from entering the second space accommodating the driver module, thereby providing a waterproof effect. Additionally, the second through holes can assist the heat dissipation of the driver module and increase the life span of the driver module. A ventilation cover can be arranged on the tube body or a transparent housing to prevent insects from the ambient from entering the tube body while allowing good heat dissipation at the same time.

In order to further the understanding regarding the present disclosure, the following embodiments are provided along with illustrations to facilitate the disclosure of the present disclosure.

DETAILED DESCRIPTION OF THE PREFERRED EMBODIMENTS

The aforementioned illustrations and the following detailed descriptions are exemplary for the purpose of further explaining the scope of the present disclosure. Other objectives and advantages related to the present disclosure will be illustrated in the subsequent descriptions and appended drawings.

First Embodiment

Figure 1:
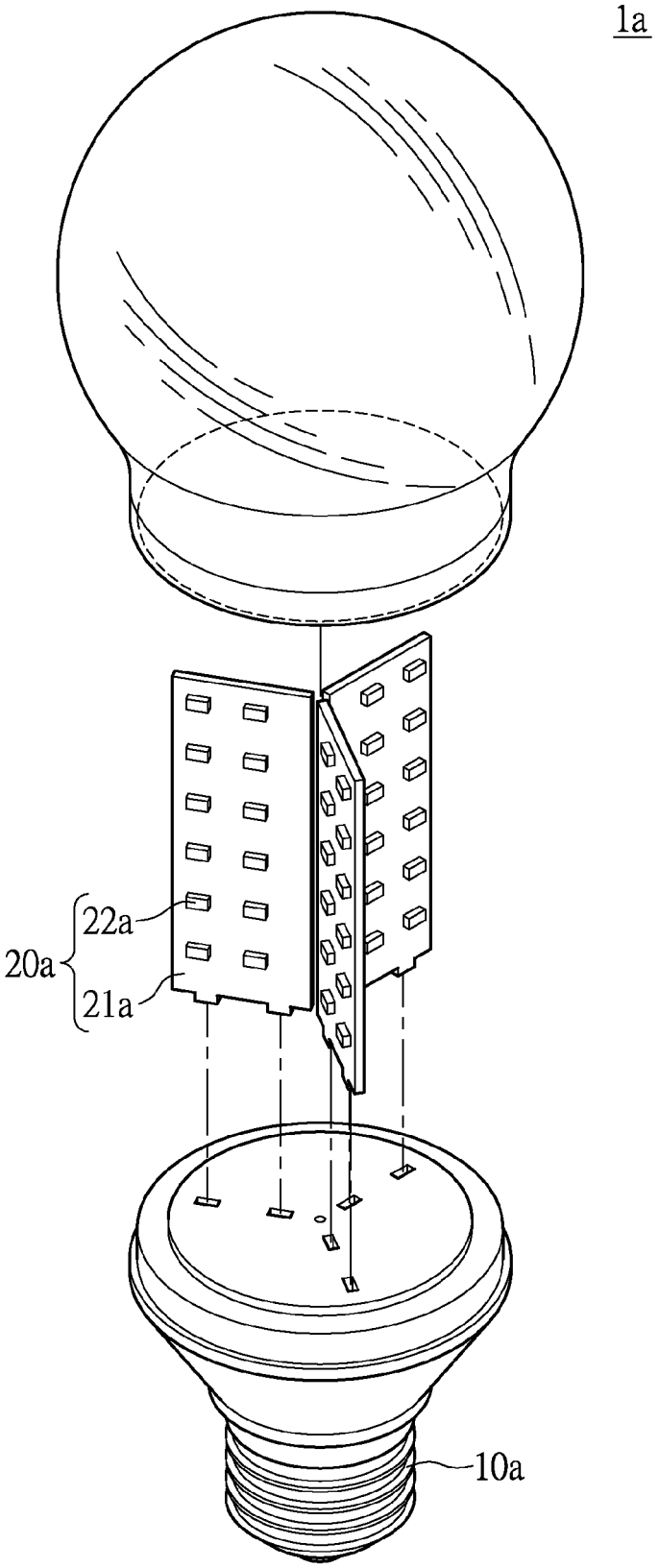
FIG.1(PRIOR ART)
FIG. 1 shows a schematic diagram of a conventional LED light bulb.
Figure 2:
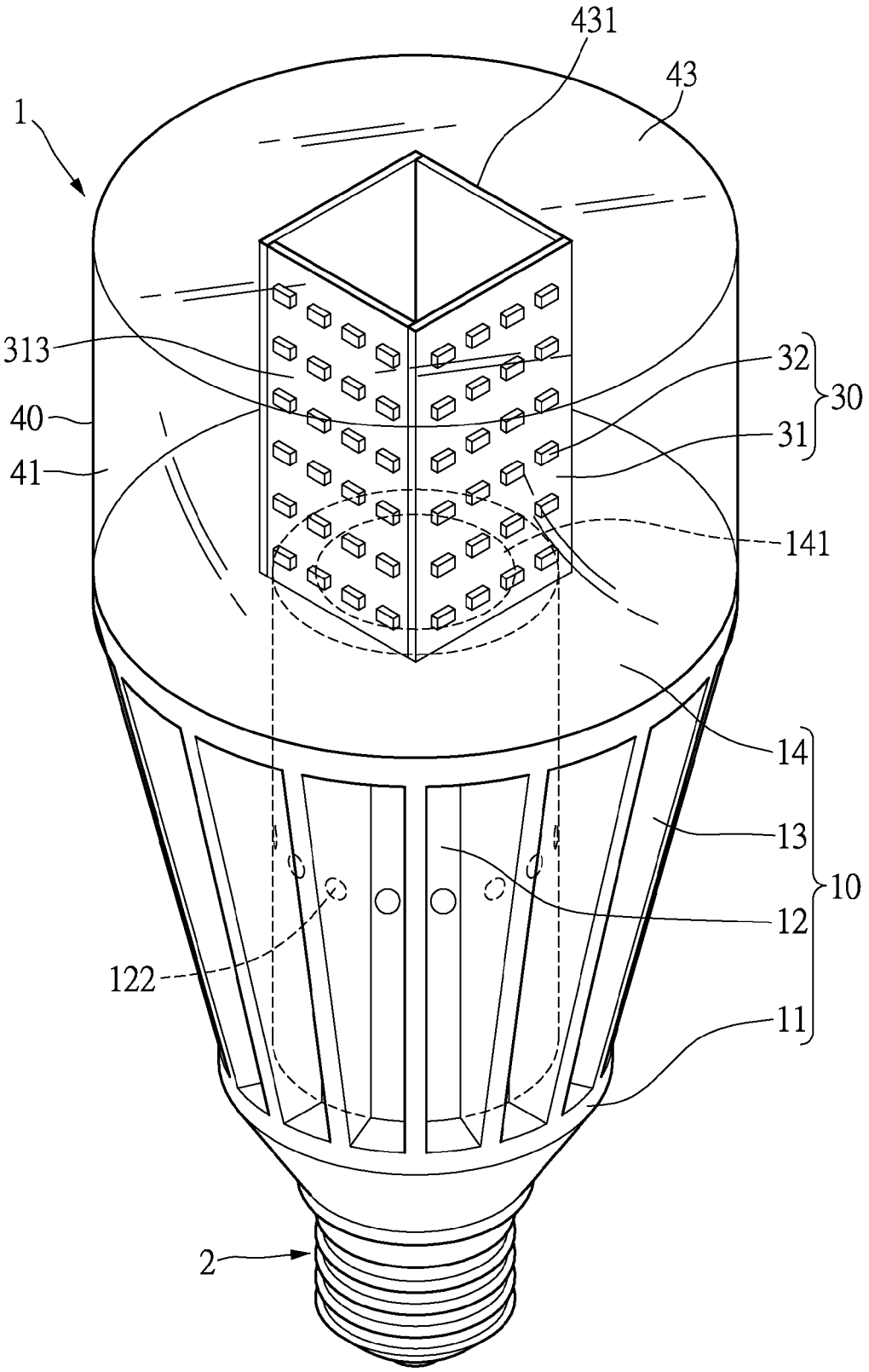
FIG. 2 shows an assembly view of an LED light bulb according to a first embodiment of the present disclosure.

FIG. 2 shows an assembly view of an LED light bulb according to a first embodiment of the present disclosure.

Figure 3:
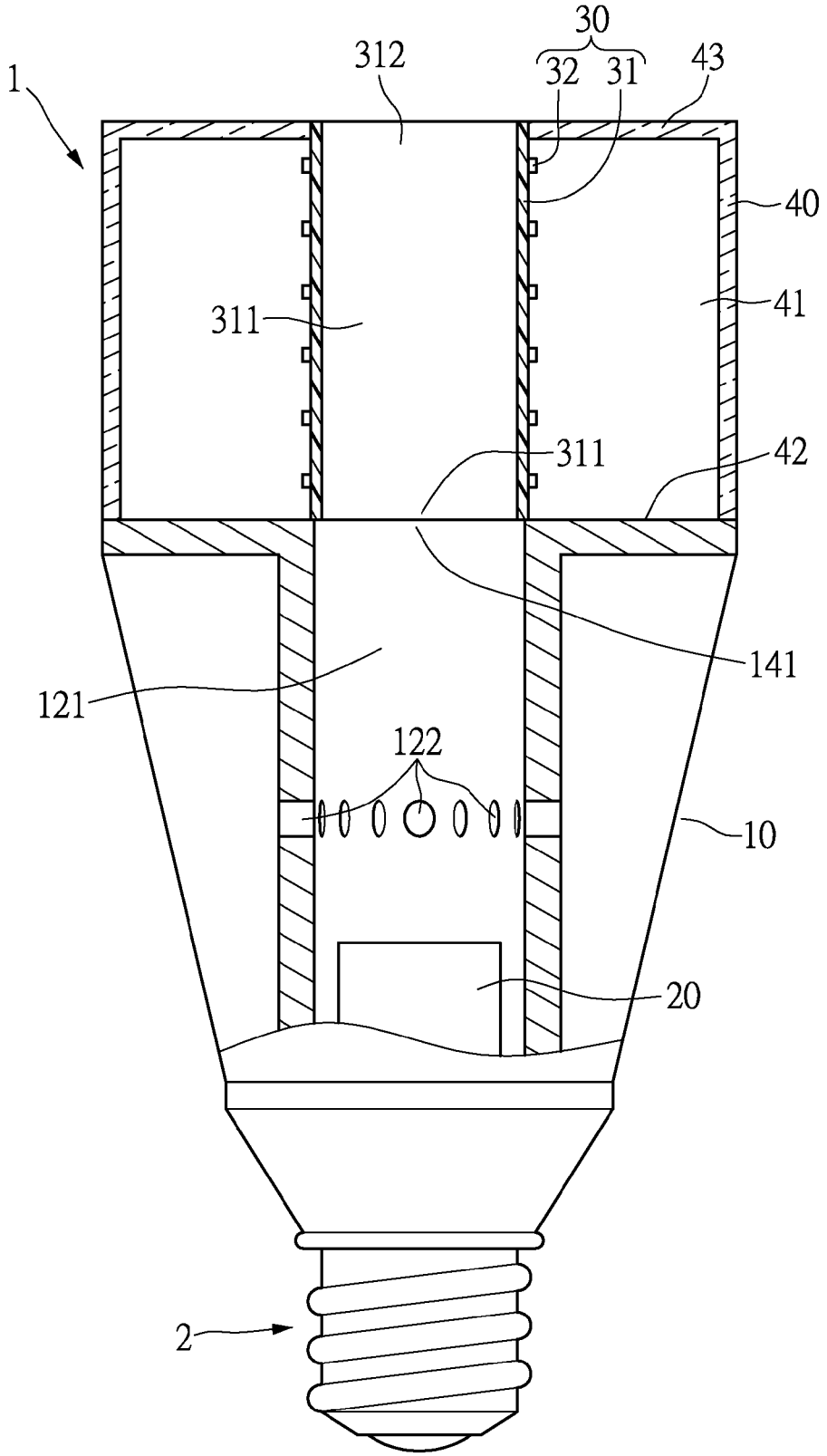
FIG. 3 shows a cross-section view of an LED light bulb according to a first embodiment of the present disclosure.

FIG. 3 shows a cross-section view of an LED light bulb according to a first embodiment of the present disclosure. The present embodiment provides an LED lighting device 1 connected to a cap 2. The LED lighting device 1 includes a heat dissipation body 10, a driver module 20 and a lighting module 30. The heat dissipation body 10 and the lighting module 30 of the present disclosure have specific structures for increasing heat dissipation, thereby achieving the objective of increasing wattage and increasing luminance. The following describes the structure of the LED lighting device 1.

The heat dissipation body 10 includes a base 11, a heat dissipation wall 12, a plurality of heat dissipation fins 13, and a top face 14. The base 11 of the heat dissipation body 10 can be a board connected to the cap 2. The heat dissipation wall 12 can be a tubular structure enclosing a heat dissipation channel 121. A plurality of first through holes 122 are formed on and encircle the heat dissipation wall 12. The lower end of the heat dissipation wall 12 is connected to the periphery of the base 11. The through holes 122 are arranged at intervals and are in fluid communication with the heat dissipation channel 121. The heat dissipation fins 13 are formed on and encircle the heat dissipation wall 12, and are each perpendicular to the heat dissipation wall 12 in order to accommodate the maximum amount of heat dissipation fins 13. The top face 14 is formed at the upper end of the heat dissipation wall 12 and is formed with a first opening 141. The periphery of the top face 14 can be tightly sealed to the heat dissipation wall 12.

Specifically, the heat dissipation fins 13 mainly increase the contact surface with the ambient air for increasing the heat dissipation effect of the heat dissipation body 10. Therefore the appearance of the heat dissipation fins 13 can be determined according to the needs of the product, and is not limited to the present disclosure. The first through holes 122 and the heat dissipation fins 13 can be arranged at intervals on the heat dissipation wall 12. By this configuration, the heat inside the heat dissipation body 10 can be dissipated through the first through holes 122 and the heat dissipation fins 13, achieving a preferred heat dissipation effect.

Additionally, the driver module 20 can be disposed in the heat dissipation body 10 and is electrically connected to the cap 2, converting the alternating current received by the cap 2 into direct current usable by the lighting module 30. The driver module 20 can be disposed at the base 11 of the heat dissipation body 10, but is not limited thereto.

The lighting module 30 includes a tube body 31 and a plurality of LED light sources 32. The tube body 31 is a circuit board structure which is hollow with two open ends being in fluid communication with each other. The LED light sources 32 are preferably encapsulated by chip on board technique (COB), to achieve high thermal conduction and a highly efficient lighting effect. The LED light sources 32 of the present disclosure can be encapsulated by conventional methods such as surface mount technology or flip-chip, but is not limited thereto.

Specifically, the tube body 31 has a hollow portion 311 and two end openings 312 which are in fluid communication with each other and aligned with the first opening 141. The tube body 31 is connected to the top face 14 of the heat dissipation body 10. One of the end openings 312 of the tube body 31 is connected to the first opening 141 of the top face 14. The LED light sources 32 are arranged on and encircle the tube body 31, achieving a lighting angle of 360 degrees. The LED light sources 32 are electrically connected to the driver module 20 thorough the tube body 31 to obtain direct current from the driver module 20.

Of particular note, heat produced by the LED light sources 32 during lighting are partially dissipated by the heat dissipation fins 13 connected to the top face 14, and partially dissipated by convection in the hollow portion 311 inside the heat dissipation body 10 in fluid communication with the tube body 31, such that heat dissipates through the first through holes 122 formed on the heat dissipation wall 12 to achieve a preferable heat dissipation effect. Therefore, the LED lighting device 1 of the present disclosure can use higher wattages for lighting without being affected by poor heat dissipation.

In a preferred embodiment, the LED lighting device 1 of the present disclosure further comprises a transparent cover 40 having an accommodating space 41, a lower opening 42 and a top face 43. The accommodating space 41 and the lower opening 42 are in fluid communication. A second opening 431 can be arranged at the top face 43 of the transparent cover 40 and aligned with the lower opening 42. The lower opening 42 of the transparent cover 40 is arranged at the top face 14 of the heat dissipation body 10. The top face 43 of the transparent cover 40 can be connected to the tube body 31 of the lighting module 30, such that the second opening 431 is in fluid communication with the end openings 312. By this configuration, air can flow from outside the transparent cover 40 and into the heat dissipation body 10 through a tubular structure, creating convection and a heat dissipation effect.

In a preferred embodiment, the tube body 31 can be a column having multiple lateral faces, including a plurality of circuit boards 313. Each of the circuit boards 313 can be an elongated board connected to other circuit boards 313. The LED light sources 32 are disposed on the circuit boards 313. The tube body 31 can also be cone-shaped, cylinder-shaped, or other shapes according to different needs of the lighting device, and is therefore not limited to column-shaped. By this configuration, the LED light sources 32 can be electrically connected to the driver module 20 through the circuit boards 313.

Second Embodiment

Figure 4:
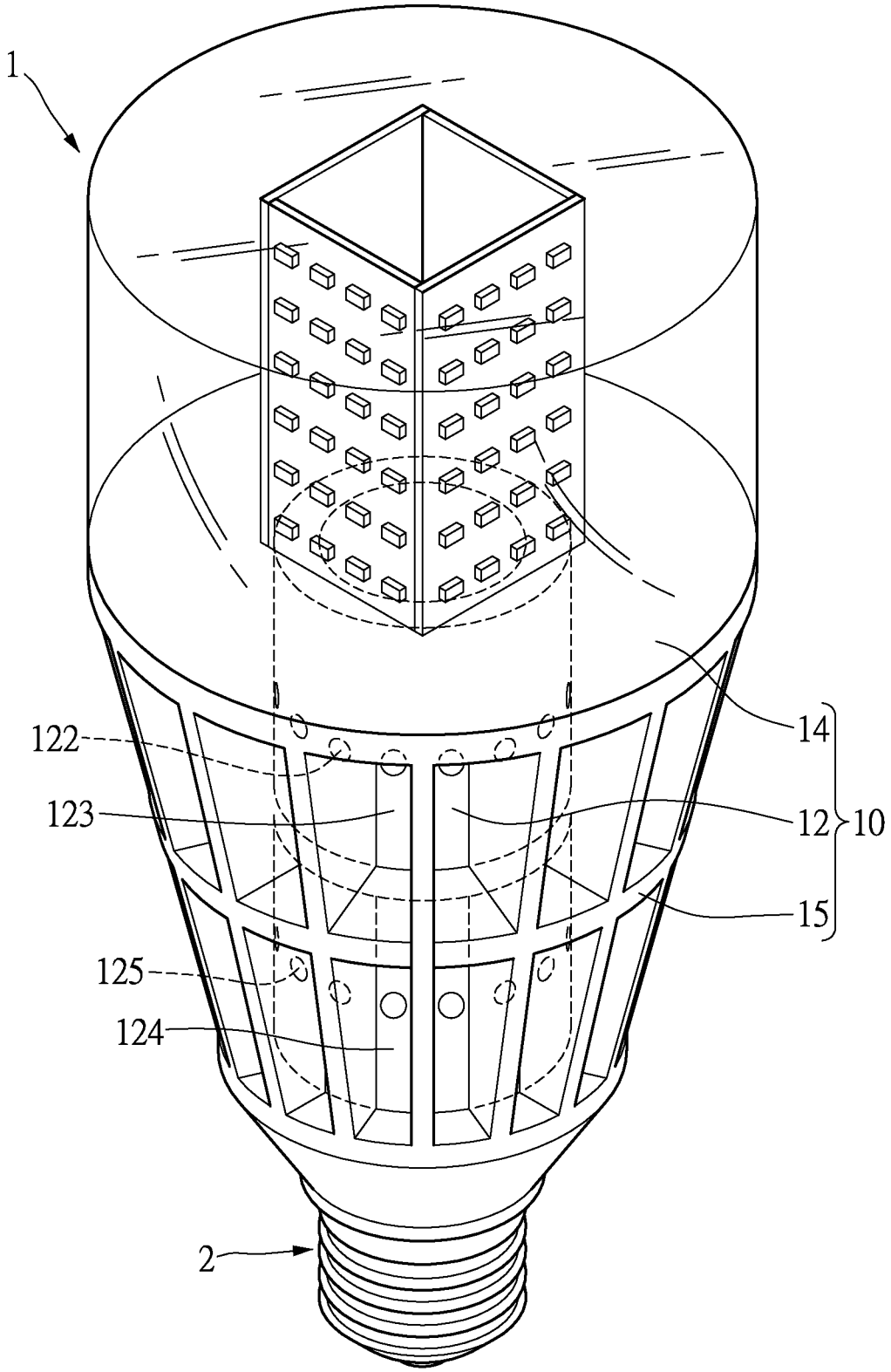
FIG. 4 shows an assembly view of an LED light bulb according to a second embodiment of the present disclosure.
Figure 5:
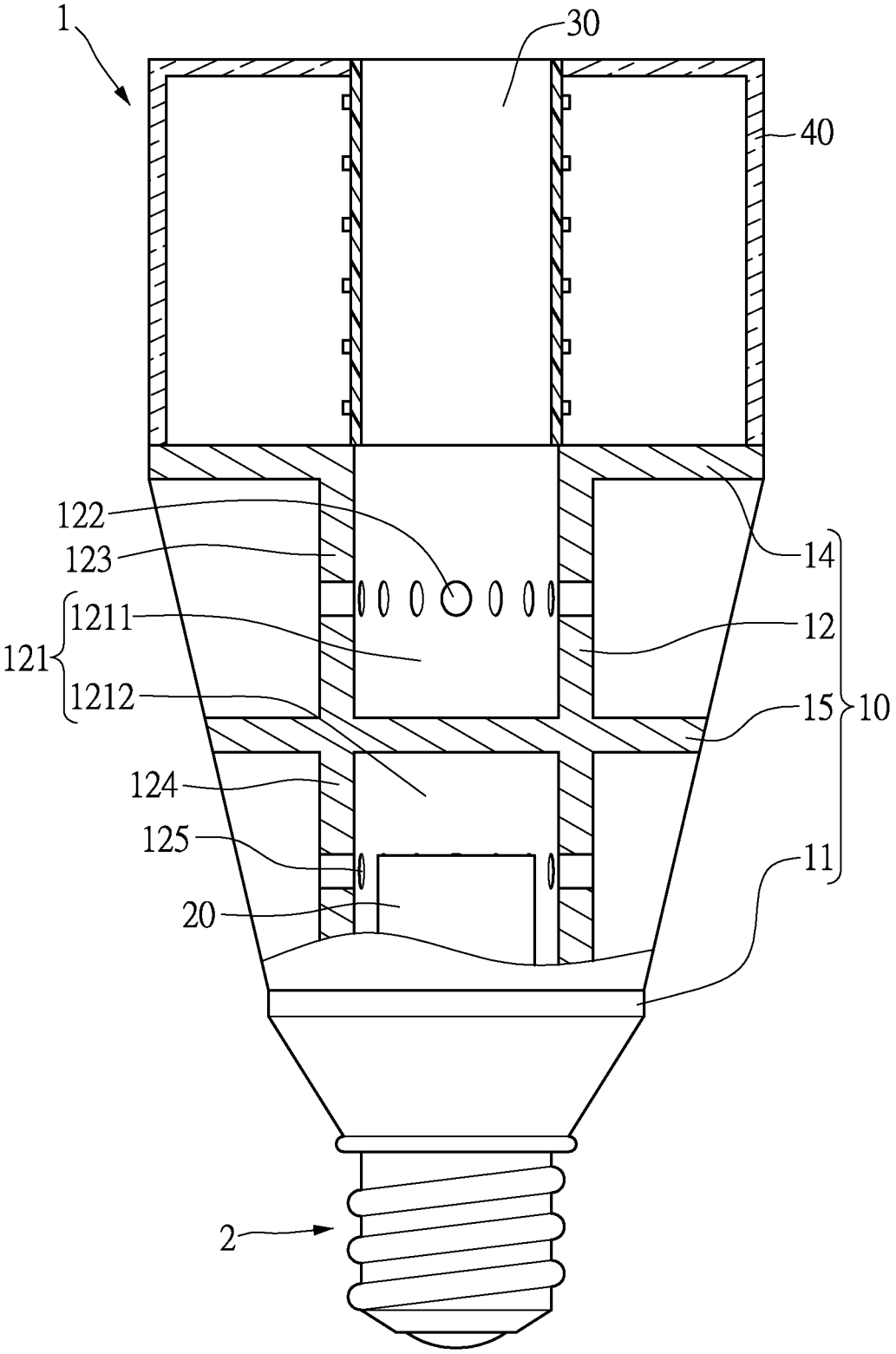
FIG. 5 shows a cross-section view of an LED light bulb according to a second embodiment of the present disclosure.

FIG. 3 shows a cross-section view of an LED light bulb according to a first embodiment of the present disclosure. FIG. 4 shows an assembly view of an LED light bulb according to a second embodiment of the present disclosure. The difference between the present embodiment and the above embodiment lies in that the heat dissipation body 10 further comprises a partition board 15 connected to the heat dissipation wall 12 for improving the waterproof effect of the present disclosure.

Specifically, the partition board 15 partitions the heat dissipation wall 12 into a first section positioned above and a second section 124 positioned below. The top face 14 of the heat dissipation body 10, the first section 123 of the heat dissipation wall 12 and the partition board 15 define a first space 1211 in the heat dissipation channel 121. The first through holes 122 of the heat dissipation wall 12 are arranged at the first section 123. By this configuration, the first through holes 122 not only increase the convection, but also discharge water and other foreign objects from the tube body 31.

Moreover, the second section 124 of the heat dissipation wall 12, the partition board 15 and the base 11 define a second space 1212 in the heat dissipation channel 121. The driver module 20 is positioned in the second space 1212. A plurality of second through holes 125 are formed on and encircle the second section 124 and are in fluid communication with the second space 1212. By this configuration, the driver module 20 can dissipate heat through the second through holes 124, and the partition board 20 above the partition board 15 can block water and other foreign objects from falling into the second space 121 and damaging the driver module 20, thereby increasing the safety of the present disclosure.

Third Embodiment

Figure 6:
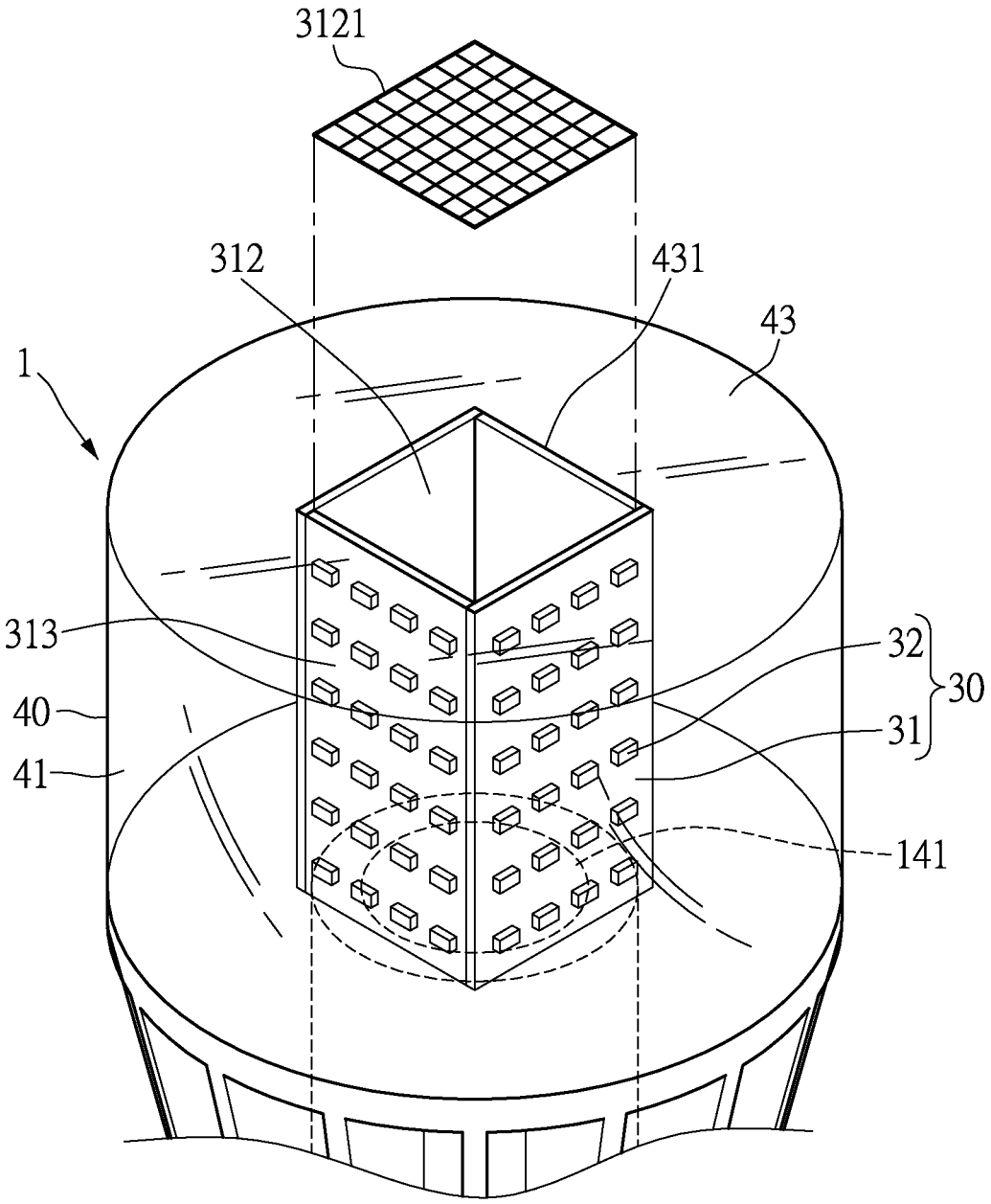
FIG. 6 shows a schematic diagram of a portion of an LED light bulb according to a third embodiment of the present disclosure.

FIG. 6 shows a schematic diagram of a portion of an LED light bulb according to a third embodiment of the present disclosure. The main difference between the present embodiment and the above embodiment lies in that the tube body 31 has a ventilation cover 3121 disposed at the end opening 312 at the transparent cover 40. The ventilation cover 3121 can be a grid with through holes therein. In another preferred embodiment, the ventilation board 3121 can be arranged at the second opening (not shown) of the transparent cover 40. By this configuration, the ventilation board 3121 can prevent insects from flying into the LED lighting device 1 while being air permeable.

Of particular note, the language of upper, lower, left, right, front, rear, etc. only reference the directions as shown in the figures. Therefore, the directions are not meant to limit the present disclosure.

In summary of the above, the LED lighting device of the present disclosure has the following advantages. The heat dissipation body of the present disclosure is in fluid communication with the ambient through the tube body of the lighting module, and together with the first through holes on the heat dissipation wall forms a good convection effect, such that the heat produced by the LED light sources can be quickly dissipated. Therefore, the present disclosure can use high wattage lighting modules while maintaining a good life span without suffering degradation of light output. The heat dissipation body of the present disclosure includes a partition board to prevent humidity in the ambient from entering the second space accommodating the driver module, thereby providing a waterproof effect. Additionally, the second through holes can assist the heat dissipation of the driver module and increase the life span of the driver module. A ventilation cover can be arranged on the tube body or a transparent housing to prevent insects from the ambient from entering the tube body while allowing good heat dissipation at the same time.

The descriptions illustrated supra set forth simply the preferred embodiments of the present disclosure; however, the characteristics of the present disclosure are by no means restricted thereto. All changes, alternations, or modifications conveniently considered by those skilled in the art are deemed to be encompassed within the scope of the present disclosure delineated by the following claims.

What is claimed is:

1. An LED lighting device connected to a cap and comprising:

a heat dissipation body including a base, a heat dissipation wall, a plurality of heat dissipation fins and a top face, wherein the base is connected to the cap, the heat dissipation wall defines a heat dissipation channel therein, one end of the heat dissipation wall is connected to the base, a plurality of first through holes are formed on and encircle the heat dissipation wall and are in fluid communication with the heat dissipation channel, the heat dissipation fins are formed on and encircle the heat dissipation wall, the top face of the heat dissipation body is formed at the other end of the heat dissipation wall and is formed with a first opening in fluid communication with the heat dissipation channel;

a driver module disposed inside the heat dissipation body and electrically connected to the cap; and a lighting module including a tube body and a plurality of LED light sources, wherein the tube body has a hollow portion and two end openings in fluid communication with the hollow portion, the tube body is connected to the top face of the heat dissipation body and one of the end openings is connected to the first opening, and the LED light sources are arranged on the tube body and are electrically connected to the driver module.

2. The LED lighting device according to claim 1, wherein the heat dissipation body includes a partition board connected to the heat dissipation wall, and the partition board partitions the heat dissipation wall into a first section and a second section.

3. The LED lighting device according to claim 2, wherein the top face of the heat dissipation body, the first section and the partition board define a first space in the heat dissipation channel.

4. The LED lighting device according to claim 3, wherein the first space is in fluid communication with the hollow portion, and the first through holes are arranged on the first section and are in fluid communication with the first space.

5. The LED lighting device according to claim 2, wherein the partition board, the second section and the base define a second space in the heat dissipation channel.

6. The LED lighting device according to claim 5, wherein the driver module is disposed in the second space, and a plurality of second through holes are formed on and encircle the second section of the heat dissipation wall and is in fluid communication with the second space.

7. The LED lighting device according to claim 1, wherein a ventilation board is disposed at the other end opening of the tube body.

8. The LED lighting device according to claim 1, further comprising a transparent cover connected to the top face of the heat dissipation body and having a second opening connected to the other end opening of the tube body.

9. The LED lighting device according to claim 1, wherein the tube body includes a plurality of circuit boards connected to each other, and the LED light sources are disposed on the circuit boards.

* * * * *